United States Patent [19]

Chipman et al.

[11] Patent Number: 4,603,857

[45] Date of Patent: Aug. 5, 1986

[54] SPRING EXERCISE DEVICE

[76] Inventors: Max C. Chipman, 1938 N. 275 West, Orem, Utah 84101; George R. Horton, 1340 E. 130 North, Springville, Utah 84663

[21] Appl. No.: 578,850

[22] Filed: Feb. 10, 1984

[51] Int. Cl.[4] ..... A63B 21/04

[52] U.S. Cl. ..... 272/136; 272/142

[58] Field of Search ..... 272/67, 901, 142, 130, 272/93, 135, 136

[56] References Cited

U.S. PATENT DOCUMENTS

| | | | |
|---|---|---|---|
| 2,542,074 | 2/1951 | Bierman | 272/67 X |
| 4,157,179 | 6/1979 | Ecklor | 272/901 X |
| 4,209,167 | 6/1980 | Jansen | 272/67 |

*Primary Examiner*—Richard J. Apley
*Assistant Examiner*—William R. Browne

[57] ABSTRACT

An exercise machine having handles adjustably positioned on a pivoted arm that is mounted to a base and wherein the pivoted arm is biased by a spring adjustably attached by a cable along the length of the arm.

8 Claims, 3 Drawing Figures

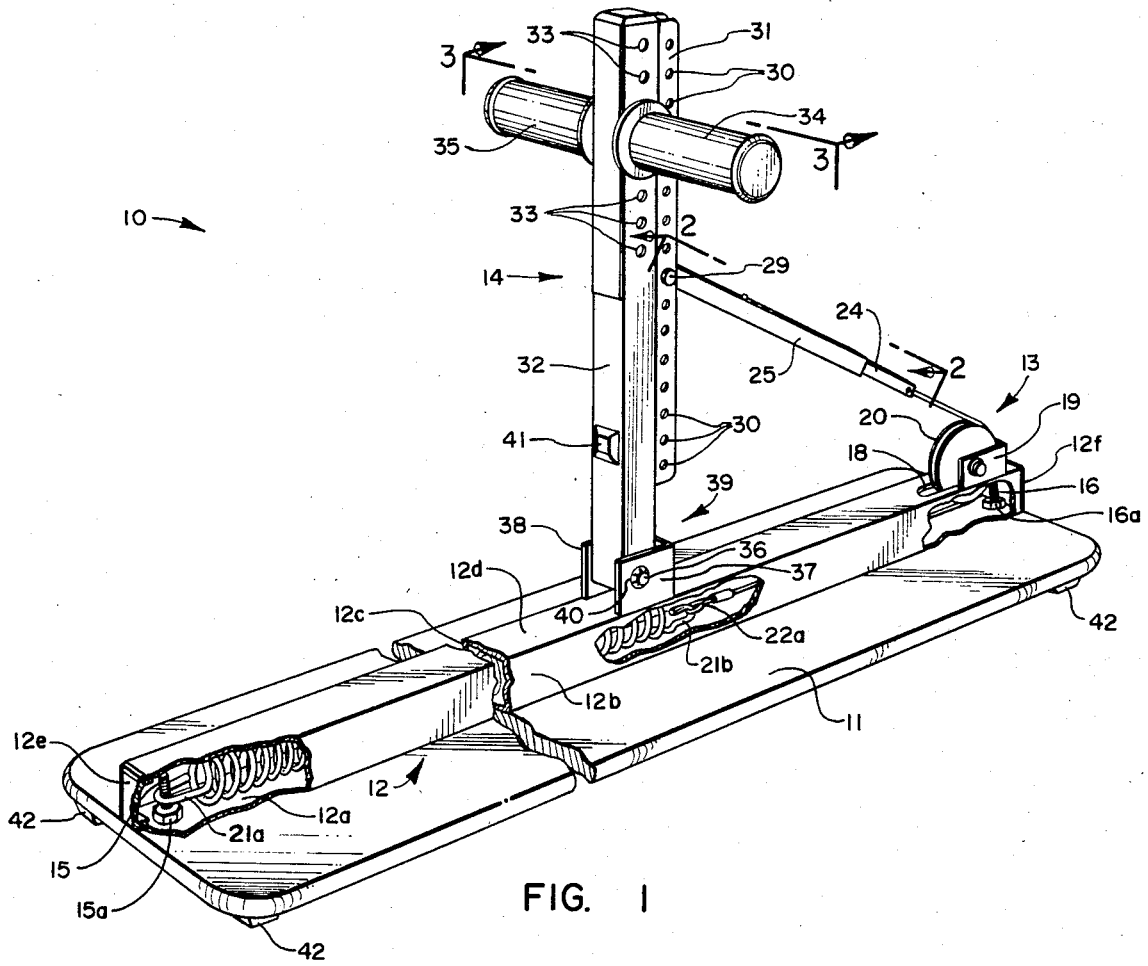
FIG. 1
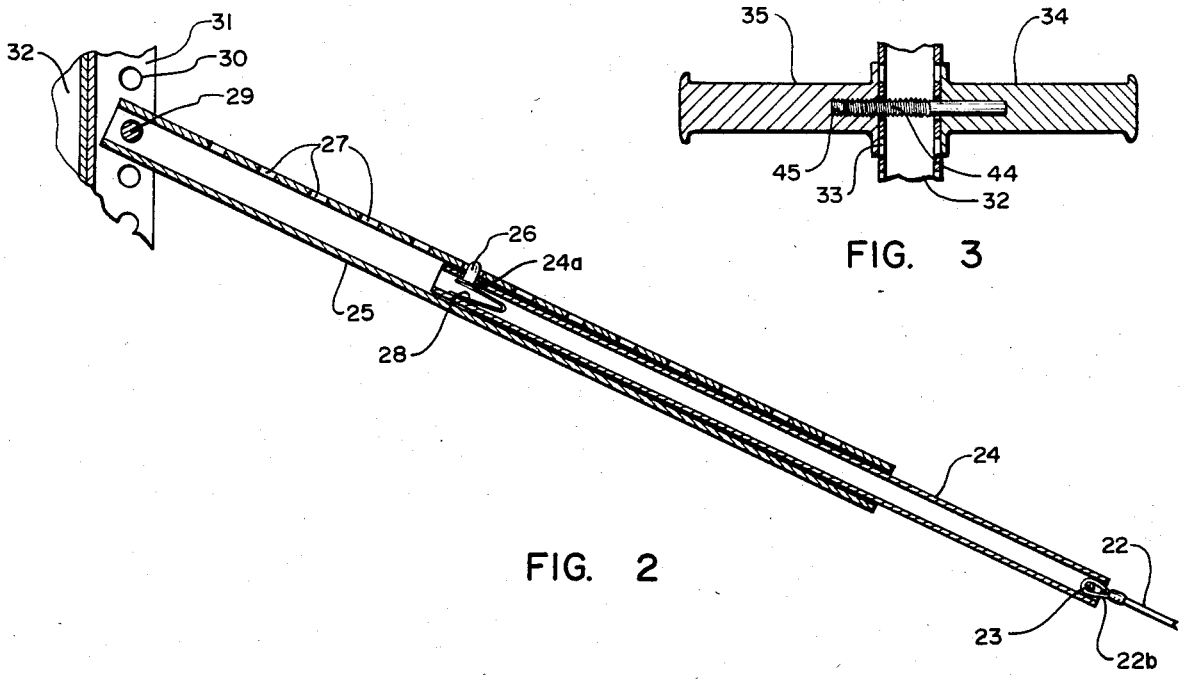
FIG. 2
FIG. 3

SPRING EXERCISE DEVICE

BRIEF DESCRIPTION OF THE INVENTION

1. Field of the Invention

This invention relates to exercise equipment and particularly to equipment suitable for exercise of the wrists, arms, shoulders, and upper body of a user.

2. Prior Art

The need to exercise various body parts as a means of maintaining good body conditioning and health has been long recognized. As a result, a great many exercise machines have been proposed and many have been developed in the past. Some of the previously known exercise machines are intended for use in strengthening the muscles of the wrist, arms, shoulders and upper torso, and some are also intended to be used in determining the strength of some muscles.

There remains a need for an exercise device that is compact, easy to use, and capable of providing varying resistances to user manipulation to thereby provide effective measurement of muscle strength as well as optimum exercise of the muscles.

SUMMARY OF THE INVENTION

Objects of the Invention

Principal objects of the present invention are to provide a compact, easily operated exercise machine that will effectively exercise, strengthen, condition, tone and test the wrist, arm, shoulder and upper torso muscles of a user.

Other objects are to provide an exercise device that can be used to perform a variety of exercises, each intended to provide a different form of stimulation to selected muscles.

Still another object is to provide an exercise device wherein resistance to movement during exercise is a function of a variable leverage system.

Features of the Invention

Principal features of the invention include a base of desired length adapted to provide a flat base surface or an upright surface on which a pivoted arm is mounted. A cable has one end selectively attached through an adjustable extension means along the length of the pivot arm, is passed around a pulley at one end of the base and is connected to one end of a spring. The other end of the spring is connected to an opposite end of the base.

Handles project from opposite sides of the pivot arm and the positions of the handles are selectively adjustable along the length of the pivot arm. The adjustable coupling of the spring and of the handles along the length of the pivot arm change the leverage applied to overcome the resistance of the spring and permit the resistance to be changed as desired for exercises to be performed.

A limit stop prevents the spring biasing the pivot arm beyond an upright position, and a bumper stop prevents injury and damage between the pivot arm and the base and a spring housing mounted thereon when the arm is pivoted in opposition to the bias of the spring.

The pivot arm can be manipulated, i.e. pivoted against the bias of the spring while the base is in a flat position to perform numerous exercises and can also be manipulated while the base is held upright on one end to perform other exercises.

Additional objects and features of the invention will become apparent to those skilled in the art from the following detailed description and claims.

THE DRAWINGS

In the drawings:

FIG. 1 is a perspective view of the exercise device of the invention, partially broken away to show interior components;

FIG. 2, a fragmentary section, taken on the line 2—2 of FIG. 1; and

FIG. 3, a similar view taken on the line 3—3 of FIG. 1.

DETAILED DESCRIPTION

Referring now to the drawings:

In the illustrated preferred embodiment, the exercise machine of the invention, shown generally at 10 includes a base 11, a spring housing 12, a spring assembly 13, and a pivot arm assembly 14.

The spring housing 12 comprises an elongate box with a bottom 12*a*, side walls 12*b* and 12*c*, a top 12*d* and ends 12*e* and 12*f*. Bolts 15 and 16, respectively, extend through base 11 and bottom 12*a* and into the spring housing. Nuts 15*a* and 16*a*, welded over holes through the bottom 12*a* during formation of the box and aligned with holes through the base, respectively, receive the bolts 15 and 16. As the bolts are turned into the nuts through the base 11 and bottom 12*a* the spring housing 12 is secured to base 11.

A slot 18 is formed in top 12*d* adjacent end 12*f*, and a bracket 19 positioned adjacent to the sides of the slot at one end thereof journals the axle of a pulley 20 that extends partially through the slot and into the housing.

A spring 21, in the housing 12, has one end 21*a* connected to bolt 15 and the other end 21*b* connected to a loop 22*a* of a cable 22. The cable 22 passes around pulley 20 and a loop 22*b* thereof, FIG. 2, is connected by a pin 23 to a tubular extension 24 that telescopes inside one end of a link 25.

The loop 22*b* extends into one end of extension 24, and the pin 23 extends through the end of the extension to hold the cable. The other end of extension 24 has a hole 24*a* therethrough and the head of the lock pin 26 extends through the hole 24*a* to fit into a selected one of the multiple holes 27 provided in the link 25. A hairpin spring 28 in the extension 24 biases the lock pin 26 through hole 24*a* and a hole 27 and allows the locking pin to be pushed back through the holes as the position of extension 24, relative to link 25, is varied, as will be further explained. The other end of link 25 has a pivot pin 29 extending therethrough and through a selected one of a multiple of holes 30 formed in a link adjustment member 31 fixed along the length of arm 32.

A series of spaced apart holes 33 are provided through one end of arm 32 to provide attachment means for handles 34 and 35. A pivot pin 36 extends through opposite faces 37 and 38 of a U-shaped bracket 39 and the other end of arm 32. Lock nuts 40 on the ends of pin 36 hold the pin in place.

A bumper stop 41, preferable of suitable resilient plastic or other such resilient matter, is affixed by bonding or the like to a face of arm 32 so that engagement of the arm 32 with the top 12*d* of the spring housing is limited, as will be further explained.

Resilient feet 42 may be provided, if desired, at each corner of base 11 on the face opposite the spring housing. The feet, if provided, will hold the exercise machine 10 against slippage when the base 11 is being used on a flat or hard surface.

Handles 34 and 35 include a threaded projecting pin 44, and the handle 35 contains an interiorly threaded socket 45 to receive the pin. The pin 44 is then inserted through a hole 33 and is threaded into socket 45 to secure the handle to arm 32.

In operation, the exercise machine 10 can be used for a wide variety of exercises. When placed with base 11 on a solid surface a user may place an elbow on the surface, grasp a handle and pivot the arm 32 against the force of spring 21. Alternatively, the user, while standing, can push rearwardly on a handle 34 or 35 to strengthen other arm and upper torso muscles.

The machine 10 can be used to strengthen leg and lower torso muscles by standing it on end and using leg to push against a handle, against the bias of the spring 21.

Also, a user can sit on one end of the base 11, and while grasping both handles, push or pull the handles against the bias of spring 21. This exercises arms, shoulder and mid-section.

The same machine can also be used by placing the base 11 against the chest of the user who can then push or pull the handle against the bias of the spring.

The degree of difficulty encountered by a user in pivoting the pivot arm is determined by the location of the connection of link 25 along the length of arm 32 and by the location of handles 34 and 35 along the arm 32. The leverage used by a person exercising to overcome the spring bias is determined by the distance between the handles and the link 25, and varying such leverage will, of course, vary the resistance to exercise encountered by the user.

Although a preferred form of our invention has been herein disclosed, it is understood that the present disclosure is by way of example and that variations are possible without departing from the subject matter coming within the scope of the following claims, which subject matter we regard as our invention.

We claim:

1. An exercise device comprising a base;

a spring housing extending centrally across the base, whereby portions of the base extend outwardly from opposite sides of the housing;

a spring in the housing having one end thereof fixed to the base at one end of the housing;

a pulley carried by an opposite end of the housing and rotatable into the housing a pivot arm having one end thereof pivotally mounted to the housing intermediate the ends thereof;

a cable having one end fixed to the other end of the spring, in the housing passed around the pulley, and its other end connected to the pivot arm intermediate the length thereof; and handle means connected to and projecting from the pivot arm.

2. An exercise device as in claim 1, further including a limit stop to prevent pivoting of the pivot arm by the spring beyond a position extending substantially normal to the base.

3. An exercise device as in claim 1, further including extension means interconnecting the cable and the pivot arm, said extension means including means to change the length thereof whereby the pivot arm will remain biased by the spring to be substantially normal to the base irrespective of the position along the pivot arm at which the extension means is attached.

4. An exercise device as in claim 3, further including means to adjustably position the handle means along the length of the pivot arm.

5. An exercise device as in claim 4, further including a limit stop to prevent pivoting of the pivot arm by the spring beyond a position extending substantially normal to the base.

6. An exercise device as in claim 1, further including means to adjustably position the handle means along the length of the pivot arm.

7. An exercise device as in claim 6, further including a limit stop to prevent pivoting of the pivot arm by the spring beyond a position extending substantially normal to the base.

8. An exercise device as in claim 7, further including a spring housing fixed to the base;

means mounting the spring in the housing;

a slot in the spring housing; and means mounting the pulley to extend into the spring housing and to project therefrom.

* * * * *